US007107904B2

(12) United States Patent
Kusaka

(10) Patent No.: US 7,107,904 B2
(45) Date of Patent: Sep. 19, 2006

(54) LIQUID FEEDER INCLUDING IMPRESSION CYLINDER HAVING GRIPPER UNIT AND COVER MEMBER

(75) Inventor: Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 11/076,013

(22) Filed: Mar. 10, 2005

(65) Prior Publication Data

US 2005/0199146 A1 Sep. 15, 2005

(30) Foreign Application Priority Data

Mar. 12, 2004 (JP) ..... 2004-070090

(51) Int. Cl.
*B41F 21/04* (2006.01)

(52) U.S. Cl. ..... 101/409; 101/118; 101/246

(58) Field of Classification Search ..... 101/409, 101/415.1, 116–120, 246; 271/277, 82; 118/213, 118/406, 503
See application file for complete search history.

(56) References Cited

U.S. PATENT DOCUMENTS 3,163,558 A 12/1964 Keith
5,671,671 A * 9/1997 Wyssmann et al. ..... 101/120
5,960,716 A 10/1999 Schaede

FOREIGN PATENT DOCUMENTS

JP 2000-504643 A 4/2000
JP 2001-225445 A 8/2001

* cited by examiner

*Primary Examiner*—Leslie J. Evanisko
(74) *Attorney, Agent, or Firm*—Birch, Stewart, Kolasch & Birch, LLP

(57) ABSTRACT

Gap guards are attached to a notch of an impression cylinder in such a manner as to allow grippers to project from inside the notch, and have respective guide surfaces. The guide surfaces extend between a circumferentially first end portion and a second end portion of the notch and have a curvature substantially equal to that of the outer circumferential surface of the impression cylinder. The guide surfaces are flush with the outer circumferential surface of the impression cylinder at the second end portion, whereas a clearance is formed between the guide surfaces and the outer circumferential surface of the impression cylinder at the first end portion. Grippers have respective guide surfaces. The guide surfaces have a curvature substantially equal to that of the outer circumferential surface of the impression cylinder such that the guide surfaces are flush with the outer circumferential surface of the impression cylinder at the first end portion.

12 Claims, 10 Drawing Sheets

LIQUID FEEDER INCLUDING IMPRESSION CYLINDER HAVING GRIPPER UNIT AND COVER MEMBER

The entire disclosure of Japanese Patent Application No. 2004-070090 filed on Mar. 12, 2004, including specification, claims, drawings and summary is incorporated herein by reference in its entirety.

BACKGROUND OF THE INVENTION

1. Field of the Invention

The present invention relates to a liquid feeder for feeding liquid, such as ink or varnish, to a sheet held on an impression cylinder so as to perform, for example, printing or coating on the sheet. More particularly, the invention relates to a liquid feeder for use in a screen printing unit of a screen printing machine for performing screen printing on sheets.

2. Description of the Related Art

A conventional screen printing machine employs a rotary screen. The rotary screen includes a hollow cylinder rotatably supported and formed as follows: a thin screen (made of, for example, stainless steel or nickel) in which small holes are etched in image patterns is formed into a cylindrical shape. In the interior of the hollow cylinder are provided an ink fountain fixedly supported by a frame, and a squeegee. The squeegee pushes out ink through the small holes of the hollow cylinder, thereby printing the image patterns on sheets. In view of its capability of thick-application printing in special ink or the like, rotary screen printing is employed for imparting high quality to, for example, appearance and tactile impression.

When printing is performed on sheets by use of such a rotary screen, the following problem is potentially involved. Since a sheet is held on an impression cylinder, which is in contact with the rotary screen, by means of a gripper, projection of the gripper from the outer circumferential surface of the impression cylinder may cause damage to the rotary screen.

In order to cope with the above problem, Japanese Kohyo (PCT) Patent Publication No. 2000-504643 discloses the following technique. A gripper and a gripper pad are disposed in the interior of a notch of an impression cylinder so as to prevent projection of the gripper and gripper pad from the outer circumferential surface of the impression cylinder. An openable and closable cover is provided for covering the notch. When a sheet is to be gripped or released, the cover is opened or closed synchronously with gripping or ungripping of the gripper, thereby allowing gripping or releasing of the sheet and preventing damage to the rotary screen, which could otherwise result from protrusion of the rotary screen into the notch of the impression cylinder or contact between the rotary screen and a projecting object (gripper).

In order to cope with the above problem, Japanese Patent Application Laid-Open (kokai) No. 2001-225445 discloses the following technique. In place of the gripper and the gripper pad, a suction head is provided in the interior of the notch of the impression cylinder. A portion of the notch other than that where the suction head is provided is covered with a cover. When a sheet is to be held, the suction head is activated to suction-hold the sheet. When a sheet is to be released, the suction head is deactivated to release the sheet. In this manner, a sheet is held or released, and there is prevented damage to the rotary screen, which could otherwise result from protrusion of the rotary screen into the notch of the impression cylinder or contact between the rotary screen and a projecting object.

However, the impression cylinder described in Japanese Kohyo (PCT) Patent Publication No. 2000-504643 is rotated while the cover that covers the entire notch undergoes opening and closing. Accordingly, when the notch is covered with the cover, high-speed rotation of the impression cylinder may cause vibration of the cover, resulting in a failure to align the cover with the outer circumferential surface of the impression cylinder. Therefore, application of the disclosed technique to high-speed printing is difficult. Also, the vibrating cover may come into contact with the hollow cylinder of the rotary screen, causing damage to the rotary screen.

In the impression cylinder described in Japanese Patent Application Laid-Open (kokai) No. 2001-225445, the suction mechanism for suction-holding a sheet becomes complex, resulting in increased cost. Also, when a sheet is transferred to the suction mechanism from an upstream cylinder, deformation (undulation) of the sheet in the sheet width direction may cause failure of the suction mechanism to suction-hold the sheet.

Occurrence of such a problem is not limited to the case where thick-application printing is performed on sheets in special ink or the like by use of the rotary screen. Such a problem may also arise in the case where liquid is fed from a liquid-feeding cylinder to a sheet held on the impression cylinder, as in the case of application of varnish to a sheet by use of the rotary screen.

SUMMARY OF THE INVENTION

In view of the foregoing, an object of the present invention is to provide a liquid feeder capable of feeding liquid, in a favorable condition and at low cost, from a liquid-feeding cylinder to a sheet held on an impression cylinder rotating even at high speed.

To achieve the above object, according to a first aspect of the present invention, a liquid feeder comprises an impression cylinder rotatably supported and having a notch formed on its outer circumferential surface; a gripper unit disposed in the interior of the notch of the impression cylinder and including a gripper and a gripper pad for holding a sheet; a liquid-feeding cylinder in contact with the impression cylinder and adapted to feed liquid to the sheet held by the gripper unit; and a cover member fixedly attached to the notch in such a manner as to allow the gripper of the gripper unit to project from inside the notch, the cover member having, as a part of its outer surface, a guide surface extending between a first end portion of the notch and a second end portion of the notch with respect to the circumferential direction of the impression cylinder and having a curvature substantially equal to that of the outer circumferential surface of the impression cylinder. In the liquid feeder, the gripper has, as a part of its outer surface, a guide surface which has a curvature substantially equal to that of the outer circumferential surface of the impression cylinder in such a manner that, when the gripper and the gripper pad grip the sheet therebetween, the guide surface of the gripper is flush, in a substantially continuous manner, with the outer circumferential surface of the impression cylinder at the circumferentially first end portion of the notch; the guide surface of the cover member is flush, in a continuous manner, with the outer circumferential surface of the impression cylinder at the circumferentially second end portion of the notch, and a clearance is formed between the guide surface of the cover member and the outer circumferential surface of the impression cylinder at the circumferentially first end portion of the notch; and the gripper and the cover member prevent protrusion of the liquid-feeding cylinder into the notch of the impression cylinder.

According to a second aspect of the present invention, in the liquid feeder according to the first aspect, the guide surface of the cover member and the guide surface of the gripper of the gripper unit overlap each other with respect to the axial direction of the impression cylinder.

According to a third aspect of the present invention, in the liquid feeder according to the first aspect, the guide surface of the cover member and the outer circumferential surface of the impression cylinder overlap each other with respect to the axial direction of the impression cylinder.

According to a fourth aspect of the present invention, in the liquid feeder according to the first aspect, the cover member comprises a plurality of bar-like gap guards provided at predetermined intervals along the axial direction of the impression cylinder.

According to a fifth aspect of the present invention, in the liquid feeder according to the fourth aspect, the gap guards and the gripper units differ in position with respect to the axial direction of the impression cylinder.

According to a sixth aspect of the present invention, the liquid feeder according to the fourth aspect further comprises an auxiliary gap guard provided in such a manner that its outer surface is flush, in a continuous manner, with the outer circumferential surface of the impression cylinder at the circumferentially first end portion of the notch of the impression cylinder, with no gap being formed between the auxiliary gap guard and the outer circumferential surface of the impression cylinder, the auxiliary gap guard having a relief surface which is formed at the circumferentially first end portion and is substantially identical in shape with an upper end surface of the gripper pad of the gripper unit; and a contact member provided on the outer circumferential surface of the liquid-feeding cylinder, cooperating with and corresponding to the relief surface of the auxiliary gap guard.

According to a seventh aspect of the present invention, in the liquid feeder according to the sixth aspect, the shape of the contact member is set such that the contact member comes into close contact with the relief surface of the auxiliary gap guard with no gap formed therebetween.

According to an eighth aspect of the present invention, in the liquid feeder according to the seventh aspect, the auxiliary gap guard and the contact member prevent deformation of the liquid-feeding cylinder.

According to a ninth aspect of the present invention, the liquid feeder according to the fourth aspect further comprises a relief member provided in the notch of the impression cylinder at the circumferentially first end portion of the notch, being substantially identical in shape with the gripper pad, and having a relief surface; and a contact member provided on the outer circumferential surface of the liquid-feeding cylinder, cooperating with and corresponding to the relief member.

According to a tenth aspect of the present invention, in the liquid feeder according to the ninth aspect, the shape of the contact member is set such that the contact member comes into close contact with the relief surface of the relief member with no gap formed therebetween.

According to an eleventh aspect of the present invention, in the liquid feeder according to the tenth aspect, the relief member and the contact member prevent deformation of the liquid-feeding cylinder.

According to a twelfth aspect of the present invention, in the liquid feeder according to the first aspect, the cover member comprises a plate-like gap guard provided in such a manner as to cover the notch of the impression cylinder, and having a guide surface in which a cutout is formed for allowing the gripper to project from inside the notch of the impression cylinder.

The liquid feeder according to the present invention can feed liquid, in a favorable condition and at low cost, from a liquid-feeding cylinder to a sheet held on an impression cylinder rotating even at high speed. Accordingly, when the liquid feeder is applied to the screen printing unit of a printing machine, the liquid feeder can feed special ink or the like, in a favorable condition, from a rotary screen to a sheet held on the impression cylinder rotating even at high speed, so that even high-speed printing in special ink or the like can be performed in a favorable condition at low cost. Therefore, the present invention can be effectively utilized in the printing industry and other industries.

DESCRIPTION OF THE PRESENT INVENTION

Embodiments of the present invention will next be described with reference to the drawings. The present invention is not limited to the embodiments.

First Embodiment

A first embodiment of a liquid feeder according to the present invention will be described with reference to FIGS. 1 to 4, referring to a printing machine in which the liquid feeder is applied to a screen printing unit.

Figure 1:
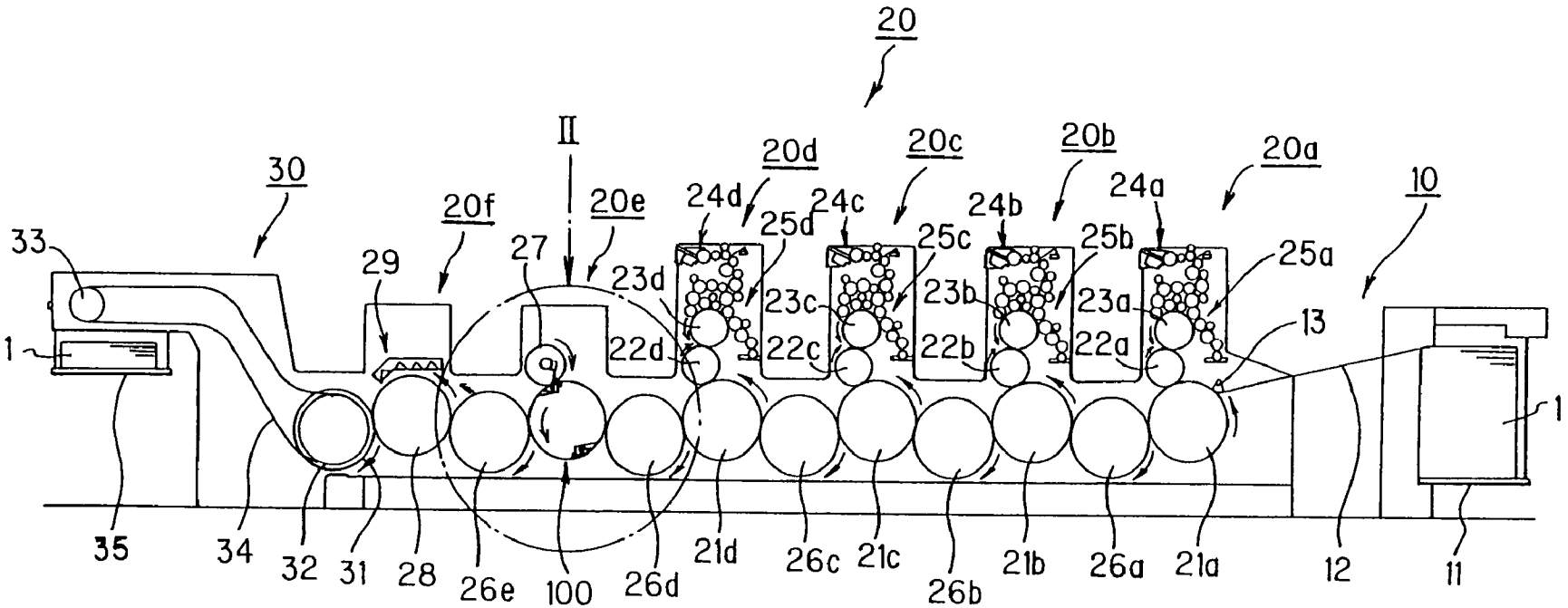
FIG. 1 is a schematic, overall, configurational view of a printing machine in which a liquid feeder according to a first embodiment of the present invention is applied to a screen printing unit.

As shown in FIG. 1, a feed platform 11 is provided in a feeder 10. A feeder board 12 is provided in the feeder 10 and adapted to feed sheets 1 one by one from the feed platform 11 to a printing section 20. A swing arm shaft pregripper 13 is provided at a distal end of the feeder board 12 and adapted to transfer the sheet 1 to an impression cylinder 21*a* of a first offset printing unit 20*a* of the printing section 20.

A rubber cylinder 22*a* is in contact with the impression cylinder 21*a* of the first offset printing unit 20*a* of the printing section 20 at a position located rotationally downstream of the swing arm shaft pregripper 13. A plate cylinder 23*a* is in contact with the rubber cylinder 22*a* at a position located rotationally upstream of the impression cylinder 21*a*. An ink feeder 24*a* is provided in the vicinity of the plate cylinder 23*a* at a position located rotationally upstream of the rubber cylinder 22*a*. A dampener 25*a* is provided in the vicinity of the plate cylinder 23*a* at a position located rotationally upstream of the ink feeder 24*a*.

An impression cylinder 21*b* of a second offset printing unit 20*b* is in indirect contact, via a transfer cylinder 26*a*, with the impression cylinder 21*a* of the first offset printing unit 20*a* at a position located rotationally downstream of the rubber cylinder 22*a*. As in the case of the first offset printing unit 20*a*, the second offset printing unit 20*b* includes a rubber cylinder 22*b*, a plate cylinder 23*b*, an ink feeder 24*b*, and a dampener 25*b*.

Also, an impression cylinder 21*c* of a third offset printing unit 20*c* is in indirect contact, via a transfer cylinder 26*b*, with the impression cylinder 21*b* of the second offset printing unit 20*b* at a position located rotationally downstream of the rubber cylinder 22*b*. As in the case of the first and second offset printing units 20*a* and 20*b*, the third offset printing unit 20*c* includes a rubber cylinder 22*c*, a plate cylinder 23*c*, an ink feeder 24*c*, and a dampener 25*c*.

Furthermore, an impression cylinder 21*d* of a fourth offset printing unit 20*d* is in indirect contact, via a transfer cylinder 26*c*, with the impression cylinder 21*c* of the third offset printing unit 20*c* at a position located rotationally downstream of the rubber cylinder 22*c*. As in the case of the first to third offset printing units 20*a* to 20*c*, the fourth offset printing unit 20*d* includes a rubber cylinder 22*d*, a plate cylinder 23*d*, an ink feeder 24*d*, and a dampener 25*d*.

Figure 2:
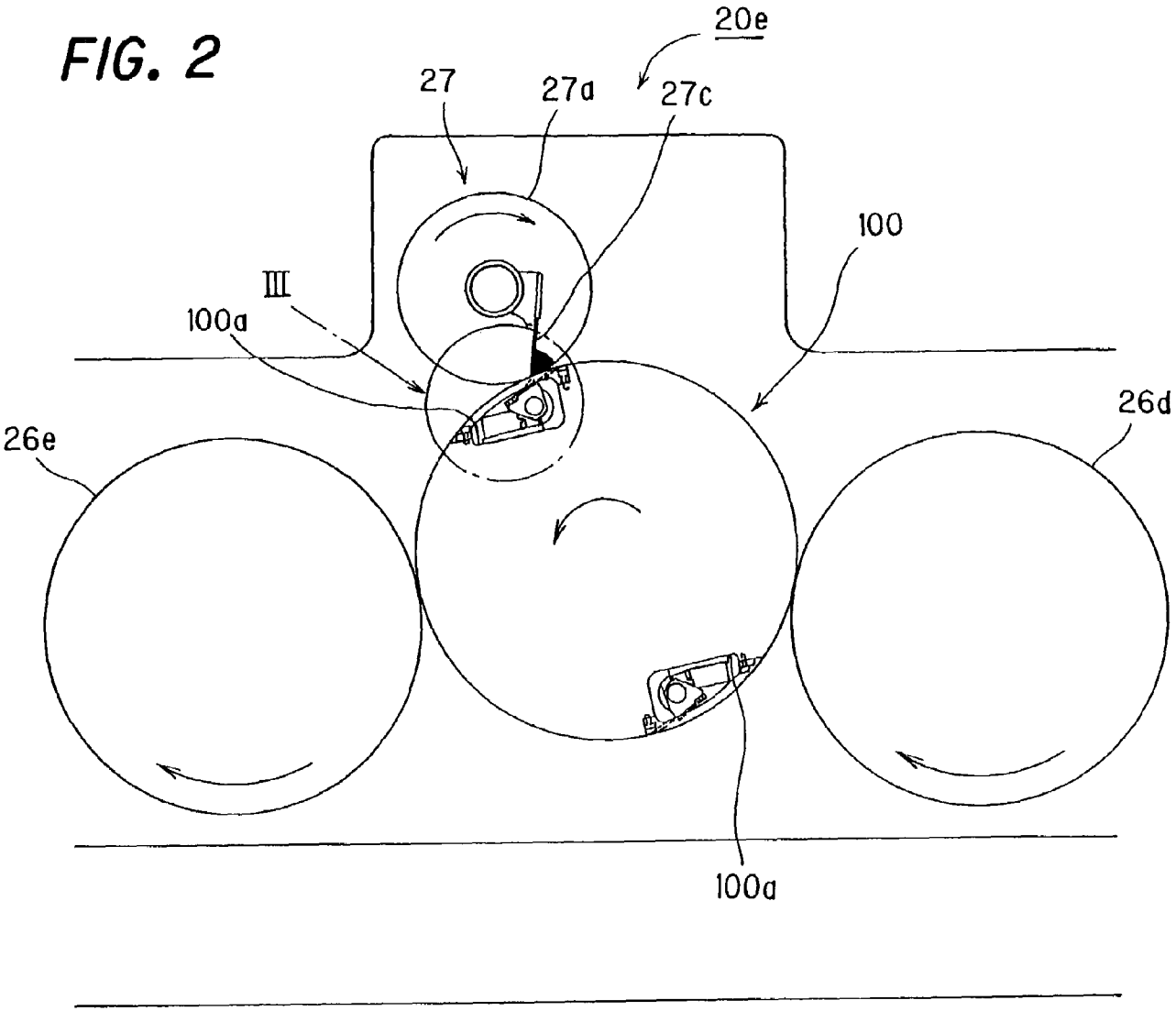
FIG. 2 is an enlarged view of a region indicated by arrow II in FIG. 1.

As shown in FIGS. 1 and 2, an impression cylinder 100 of a screen printing unit 20*e* is in indirect contact, via a transfer cylinder 26*d*, with the impression cylinder 21*d* of the fourth offset printing unit 20*d* at a position located rotationally downstream of the rubber cylinder 22*d*. The impression cylinder 100 has the following structure.

Figure 3:
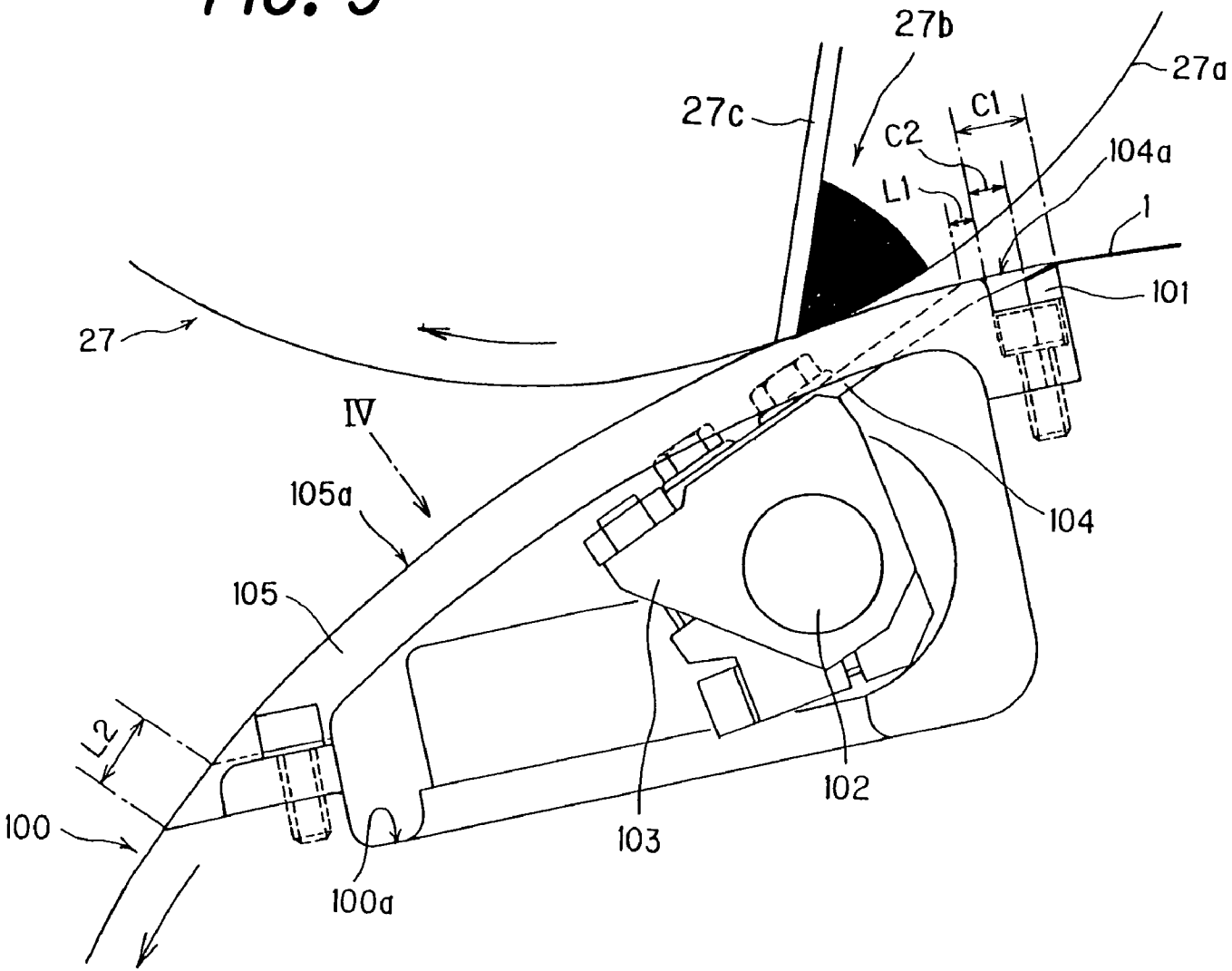
FIG. 3 is an enlarged view of a region indicated by arrow III in FIG. 2.
Figure 4:
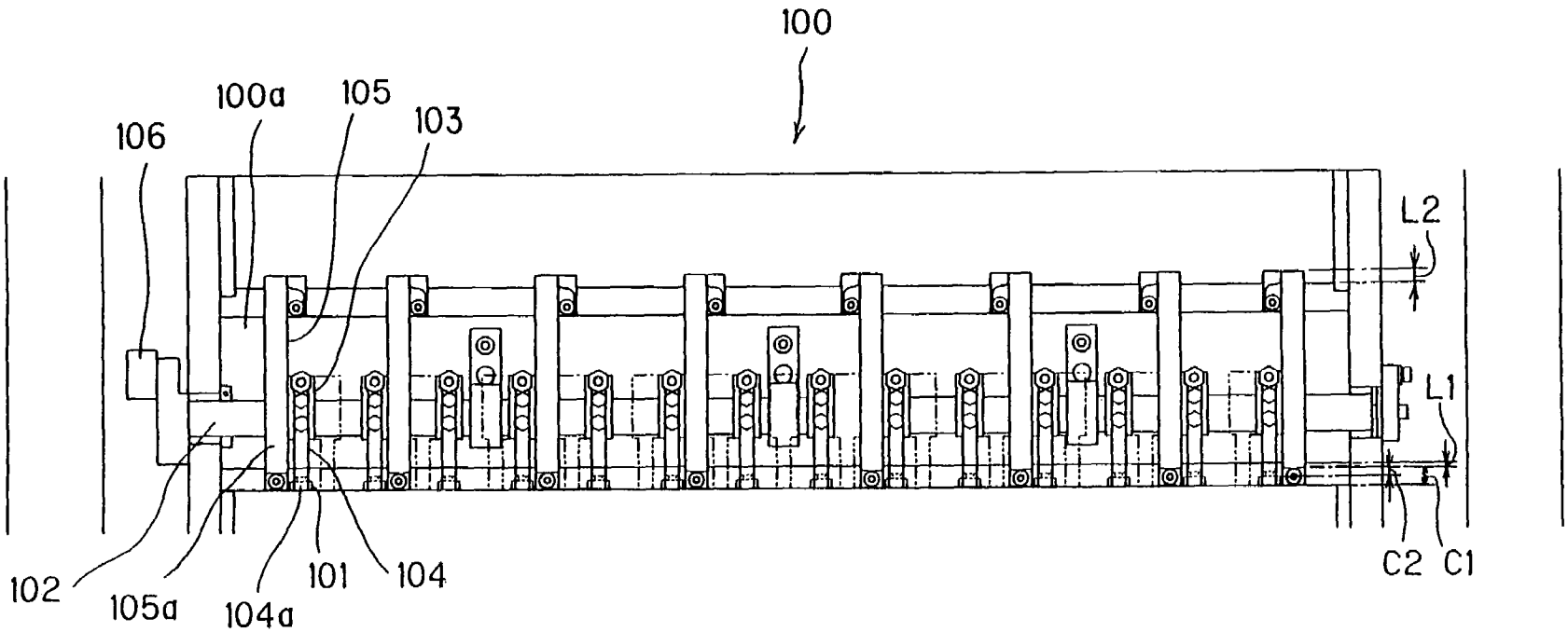
FIG. 4 is a view as viewed in the direction of arrow IV of FIG. 3.

As shown in FIGS. 2 to 4, a plurality of (in the present embodiment, two) notches 100*a* are formed on the outer circumferential surface of the impression cylinder 100 at circumferentially equal intervals while extending in the axial direction of the impression cylinder 100. A plurality of gripper pads 101 are provided in the interior of the notch 100*a* of the impression cylinder 100 at an upstream end portion (a circumferentially first end portion; a right end portion in FIG. 3; and a lower end portion in FIG. 4) of the notch 100*a* with respect to the rotational direction of the impression cylinder 100 and arranged at predetermined intervals along the axial direction of the impression cylinder 100.

Each of the gripper pads 101 is disposed in the interior of the notch 100*a* in such a manner that its upper end surface is flush, in a continuous manner, with the outer circumferential surface of the impression cylinder 100 at its rotationally upstream end and is descendingly inclined in the rotational direction of the impression cylinder 100.

A gripper shaft 102 is disposed in the interior of the notch 100*a* of the impression cylinder 100 in such a manner as to extend along the axial direction of the impression cylinder 100. The gripper shaft 102 is rotatably supported in relation to the impression cylinder 100. A plurality of gripper holders 103 are provided on the gripper shaft 102 and arranged at predetermined intervals along the axial direction of the gripper shaft 102. A plurality of grippers 104 are provided in such a manner that base end portions thereof are attached to the corresponding gripper holders 103, while tip end portions thereof rest on the corresponding gripper pads 101.

Each of the grippers 104 has a guide surface 104*a* formed on the outer surface of its tip end portion. The guide surfaces 104*a* have a curvature substantially equal to that of the outer circumferential surface of the impression cylinder 100 in such a manner that, when the grippers 104 and the corresponding gripper pads 101 grip the sheet 1 therebetween, the guide surfaces 104*a* are flush, in a substantially continuous manner, with the outer circumferential surface of the impression cylinder 100 at the rotationally upstream portion of the notch 100*a*.

A plurality of bar-like gap guards 105, which collectively serve as a cover member, are fixedly attached to the notch 100*a* of the impression cylinder 100 in such a manner as to allow the grippers 104 to project from inside the notch 100*a*, and are arranged at predetermined intervals along the axial direction of the impression cylinder 100. Each of the gap guards 105 has a guide surface 105*a*, as a part of its outer surface. The guide surface 105*a* has a curvature substantially equal to that of the outer circumferential surface of the impression cylinder 100 so as to extend along the outer circumferential surface of the impression cylinder 100 substantially between a rotationally downstream end portion and a rotationally upstream end portion of the notch 100*a*, thereby substantially establishing circumferential continuity of the outer circumferential surface of the impression cylinder 100. The gap guards 105 and the gripper pads 101 differ in position with respect to the axial direction of the impression cylinder 100.

As viewed in the axial direction of the impression cylinder 100 (FIG. 3), the guide surface 105*a* of each of the gap guards 105 has the following configuration: a clearance C1 is present between the guide surface 105*a* and the outer circumferential surface of the impression cylinder 100 at a rotationally upstream end portion of the notch 100*a*; a clearance C2 is present between the guide surface 105*a* and the gripper pad 101 at the rotationally upstream end portion of the notch 100*a*; and the guide surface 105*a* is flush, in a continuous manner, with the outer circumferential surface of the impression cylinder 100 at a rotationally downstream end portion of the notch 100*a*.

Furthermore, the position and geometry of the guide surface 105*a* of each of the gap guards 105 are selected so as to establish the following conditions: as viewed in the axial direction of the impression cylinder 100 (FIG. 3), a rotationally upstream portion of the guide surface 105*a* overlaps with the guide surface 104*a* of each of the grippers 104 over a lap region L1, and a rotationally downstream portion of the guide surface 105*a* coincides with the outer circumferential surface of the impression cylinder 100 over a lap region L2.

In FIG. 4, reference numeral 106 denotes a cam follower for rotating the gripper shaft 102. In the present embodiment, the gripper pads 101, the gripper shaft 102, the gripper holders 103, the grippers 104, and other relevant components constitute a gripper device.

As shown in FIGS. 1 to 3, a rotary screen 27, which serves as a liquid-feeding cylinder, is in contact with the impression cylinder 100 of the screen printing unit 20*e* at a position located rotationally downstream of the transfer cylinder 26*d*. The rotary screen 27 includes a hollow cylinder 27*a*, an ink fountain 27*b* provided in the interior of the hollow cylinder 27*a*, and a squeegee 27*c*. The hollow cylinder 27*a* is rotatably supported and formed as follows: a thin screen (made of, for example, stainless steel or nickel) in which small holes are etched in image patterns is formed into a cylindrical shape.

The rotary screen 27 can perform printing as follows: while the hollow cylinder 27*a* is rotated synchronously with rotation of the impression cylinder 100, the squeegee 27*c* pushes out liquid, such as special ink, contained in the ink fountain 27*b*, through the small holes of the hollow cylinder 27*a*, thereby printing image patterns corresponding to the small holes on the sheet 1 held on the impression cylinder 100.

As shown in FIG. 1, a transfer cylinder 26*e* is in contact with the impression cylinder 100 of the screen printing unit 20*e* at a position located rotationally downstream of the rotary screen 27. A transport cylinder 28 of a drying unit 20*f* is in contact with the transfer cylinder 26*e* at a position located rotationally downstream of the impression cylinder 100. A drying lamp 29 for irradiating ultraviolet rays (UV) is disposed in the vicinity of the transport cylinder 28 at a position located rotationally downstream of the transfer cylinder 26*e*.

A delivery cylinder 31 of a delivery unit 30 is in contact with the transport cylinder 28 of the drying unit 20*f* at a position located rotationally downstream of the drying lamp 29. A sprocket 32 is coaxially provided on the delivery cylinder 31 in a unitarily rotatable condition. A delivery platform 35 is provided in the delivery unit 30. A sprocket 33 is provided above the delivery platform 35. A delivery chain 34 is looped around and extends between the sprockets 32 and 33. A plurality of unillustrated delivery grippers are attached, at predetermined intervals, to the delivery chain 34.

Next will be described operation of the thus-configured printing machine in which the liquid feeder according to the present embodiment is employed.

The sheets 1 are fed one by one from the feed platform 11 of the feeder 10 onto the feeder board 12. While the swing arm shaft pregripper 13 transfers each of the sheets 1 from the feeder board 12 to the impression cylinder 21*a* of the first offset printing unit 20*a* of the printing section 20, the ink feeder 24*a* and dampener 25*a* of the first offset printing unit 20*a* feed ink and dampening water, respectively, to the plate cylinder 23*a*. When ink is transferred from the plate cylinder 23*a* to the rubber cylinder 22*a*, the ink is transferred from the rubber cylinder 22*a* to the sheet 1; i.e., the sheet 1 undergoes printing in the first color. Then, the sheet 1 is transferred, via the transfer cylinder 26*a*, to the impression cylinder 21*b* of the second offset printing unit 20*b*. Similarly to the case of the first offset printing unit 20*a*, the sheet 1 undergoes printing in the second color in the second offset printing unit 20*b*. Similarly, the sheet 1 undergoes printing in the third and fourth colors in the third and fourth offset printing units 20*c* and 20*d*, respectively. Then, the sheet 1 undergoes gripping change, via the transfer cylinder 26*d*, to gripping by the gripper pads 101 and grippers 104 of the impression cylinder 100 of the screen printing unit 20*e*. The sheet 1 undergoes thick-application printing in special ink or the like, which is effected in the previously described manner by the rotary screen 27 of the screen printing unit 20*e*.

When the sheet 1 is gripped by means of the grippers 104 and the corresponding gripper pads 101, the guide surfaces 104*a* of the grippers 104 are flush, in a substantially continuous manner, with the outer circumferential surface of the impression cylinder 100 at the rotationally upstream portion of the notch 100*a* of the impression cylinder 100. Also, the guide surfaces 105*a* of the gap guards 105 extend along the outer circumferential surface of the impression cylinder 100 in such a manner as to establish circumferential continuity between the guide surfaces 104*a* of the grippers 104 and the rotationally downstream end of the notch 100*a* of the impression cylinder 100. Accordingly, even when the rotary screen 27 comes into contact with the grippers 104, the rotary screen 27 is free from damage. Also, the rotary screen 27 does not protrude into the notch 100*a*. In other words, when the notch 100*a* comes under the rotary screen 27, the guide surfaces 104*a* of the grippers 104 and the guide surfaces 105*a* of the gap guards 105 guide the rotary screen 27 in the same manner as does the outer circumferential surface of the impression cylinder 100.

As mentioned previously, at a rotationally upstream end portion of the notch 100*a*, the clearances C1 and C2 are present respectively between the guide surfaces 105*a* of the gap guards 105 and the outer circumferential surface of the impression cylinder 100 and between the guide surfaces 105*a* of the gap guards 105 and the gripper pads 101. Accordingly, when the sheet 1 is gripped between the grippers 104 and the corresponding gripper pads 101, the gripped edge (leading edge) of the sheet 1 does not interfere with the gap guards 105, thereby preventing damage to the sheet 1.

Furthermore, as viewed in the axial direction of the impression cylinder 100, a rotationally upstream portion of the guide surface 105*a* of each of the gap guards 105 overlaps with the guide surface 104*a* of each of the grippers 104 over the lap region L1, and a rotationally downstream portion of the guide surface 105*a* coincides with the outer circumferential surface of the impression cylinder 100 over the lap region L2. Accordingly, when the rotary screen 27 moves from the guide surfaces 104*a* of the grippers 104 to the guide surfaces 105*a* of the gap guards 105, or from the guide surfaces 105*a* of the gap guards 105 to the outer circumferential surface of the impression cylinder 100, the rotary screen 27 can be reliably free from even a slight protrusion into the notch 100*a*.

After undergoing thick-application printing in special ink or the like which is effected by the rotary screen 27, the sheet 1 is transferred, via the transfer cylinder 26*e*, from the impression cylinder 100 to the transport cylinder 28 of the drying unit 20*f*. Through irradiation with UV from the drying lamp 29, the printed special ink or the like is dried. Subsequently, the sheet 1 is transferred to the delivery cylinder 31 of the delivery unit 30 and is then transported on the moving delivery chain 34 while being gripped by the delivery grippers. Then, the sheet 1 is delivered onto the delivery platform 35.

As described above, the liquid feeder of the present embodiment has the following structural features. The gap guards 105 are fixedly attached to the notch 100*a* of the impression cylinder 100 in such a manner as to allow the grippers 104 to project from inside the notch 100*a*, and have the respective guide surfaces 105*a*, as parts of their outer surfaces. The guide surfaces 105*a* extend between a first end portion and a second end portion of the notch 100*a* with respect to the circumferential direction of the impression cylinder 100 and have a curvature substantially equal to that of the outer circumferential surface of the impression cylinder 100. The guide surfaces 105*a* are flush, in a continuous manner, with the outer circumferential surface of the impression cylinder 100 at the circumferentially second end portion of the notch 100*a*, whereas a clearance is formed between the guide surfaces 105*a* and the outer circumferential surface of the impression cylinder 100 at the circumferentially first end portion of the notch 100*a*. Also, each of the grippers 104 has the guide surface 104*a* as a part of its outer surface.

The guide surfaces 104*a* have a curvature substantially equal to that of the outer circumferential surface of the impression cylinder 100 in such a manner that the guide surfaces 104*a* are flush, in a continuous manner, with the outer circumferential surface of the impression cylinder 100 at the circumferentially first end portion of the notch 100*a*. Furthermore, the guide surfaces 105*a* of the gap guards 105 and the guide surfaces 104*a* of the grippers 104 overlap each other with respect to the axial direction of the impression cylinder 100. The guide surfaces 105*a* of the gap guards 105 and the outer circumferential surface of the impression cylinder 100 overlap each other with respect to the axial direction of the impression cylinder 100.

Thus, even during high-speed printing, the liquid feeder according to the present embodiment can prevent, by means of a simple structure, collision between the grippers 104 and the rotary screen 27 and protrusion of the rotary screen 27 into the notch 100*a* without inducing vibration of the impression cylinder 100 of the screen printing unit 20*e*.

Accordingly, the liquid feeder according to the present embodiment can feed special ink or the like, in a favorable condition, from the rotary screen 27 to the sheet 1 held on the impression cylinder 100 rotating even at high speed, so that even high-speed printing in special ink or the like can be performed in a favorable condition at low cost.

At a rotationally upstream end portion of the notch 100*a*, the clearances C1 and C2 are present respectively between the guide surfaces 105*a* of the gap guards 105 and the outer circumferential surface of the impression cylinder 100 and between the guide surfaces 105*a* of the gap guards 105 and the gripper pads 101. Accordingly, when the sheet 1 is gripped between the grippers 104 and the corresponding gripper pads 101, the gripped edge (leading edge) of the sheet 1 can be prevented from colliding with the gap guards 105, thereby greatly reducing wasted paper.

As viewed in the axial direction of the impression cylinder 100, a rotationally upstream portion of the guide surface 105*a* of each of the gap guards 105 overlaps with the guide surface 104*a* of each of the grippers 104 over the lap region L1, and a rotationally downstream portion of the guide surface 105*a* coincides with the outer circumferential surface of the impression cylinder 100 over the lap region L2. Accordingly, when the rotary screen 27 moves from the guide surfaces 104*a* of the grippers 104 to the guide surfaces 105*a* of the gap guards 105, or from the guide surfaces 105*a* of the gap guards 105 to the outer circumferential surface of the impression cylinder 100, the rotary screen 27 can be free from even a slight protrusion into the notch 100*a*. Therefore, damage to the rotary screen 27 can be prevented more reliably.

Other Embodiments

Figure 5:
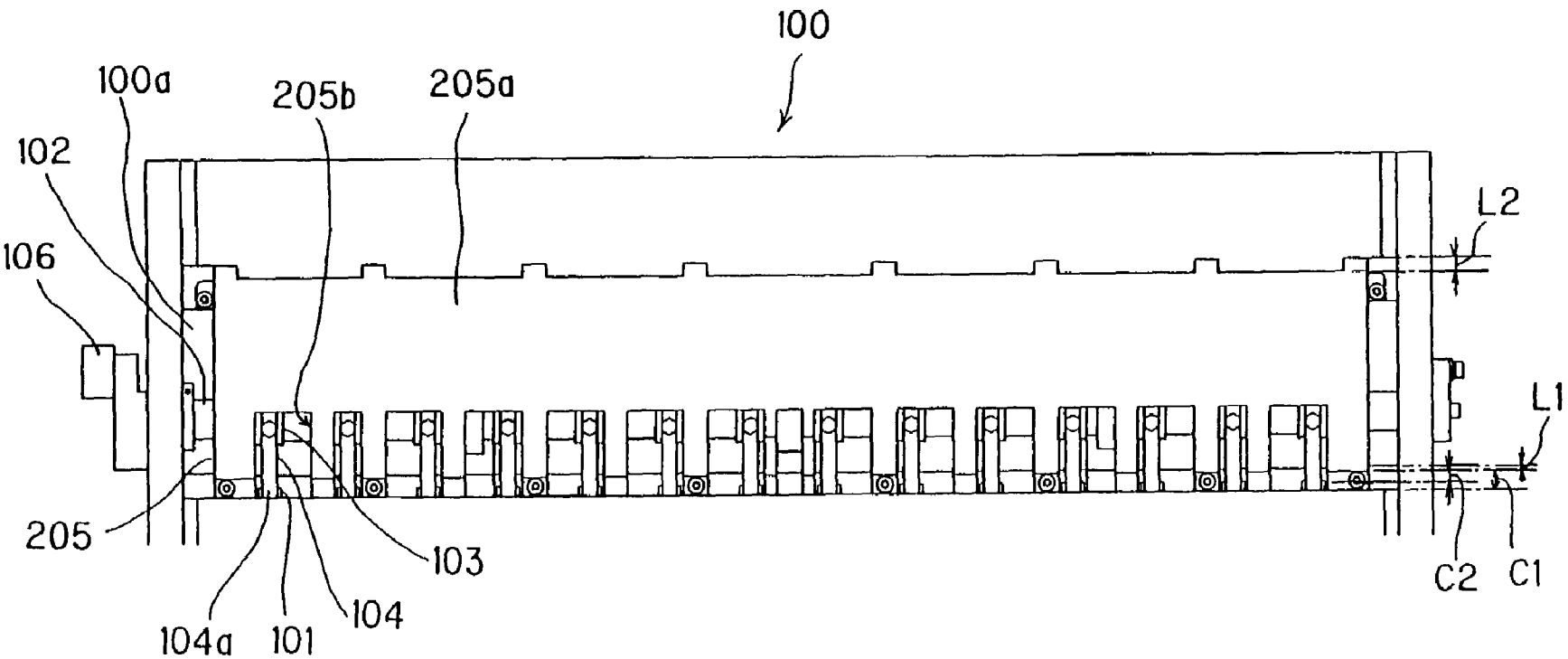
FIG. 5 is a schematic, configurational view showing essential portions of a liquid feeder according to a second embodiment of the present invention.

According to the first embodiment, a plurality of bar-like gap guards 105 are provided at predetermined intervals along the axial direction of the impression cylinder 100 in such a manner as to allow the grippers 104 to project from inside the notch 100*a* of the impression cylinder 100. In another embodiment of the present invention, as shown in FIG. 5, a plate-like gap guard 205 is fixedly attached to the notch 100*a* of the impression cylinder 100 in such a manner as to cover the notch 100*a*. The gap guard 205 has a guide surface 205*a* in which cutouts 205*b* are formed for allowing the corresponding grippers 104 to project from inside the notch 100*a* of the impression cylinder 100.

Figure 6:
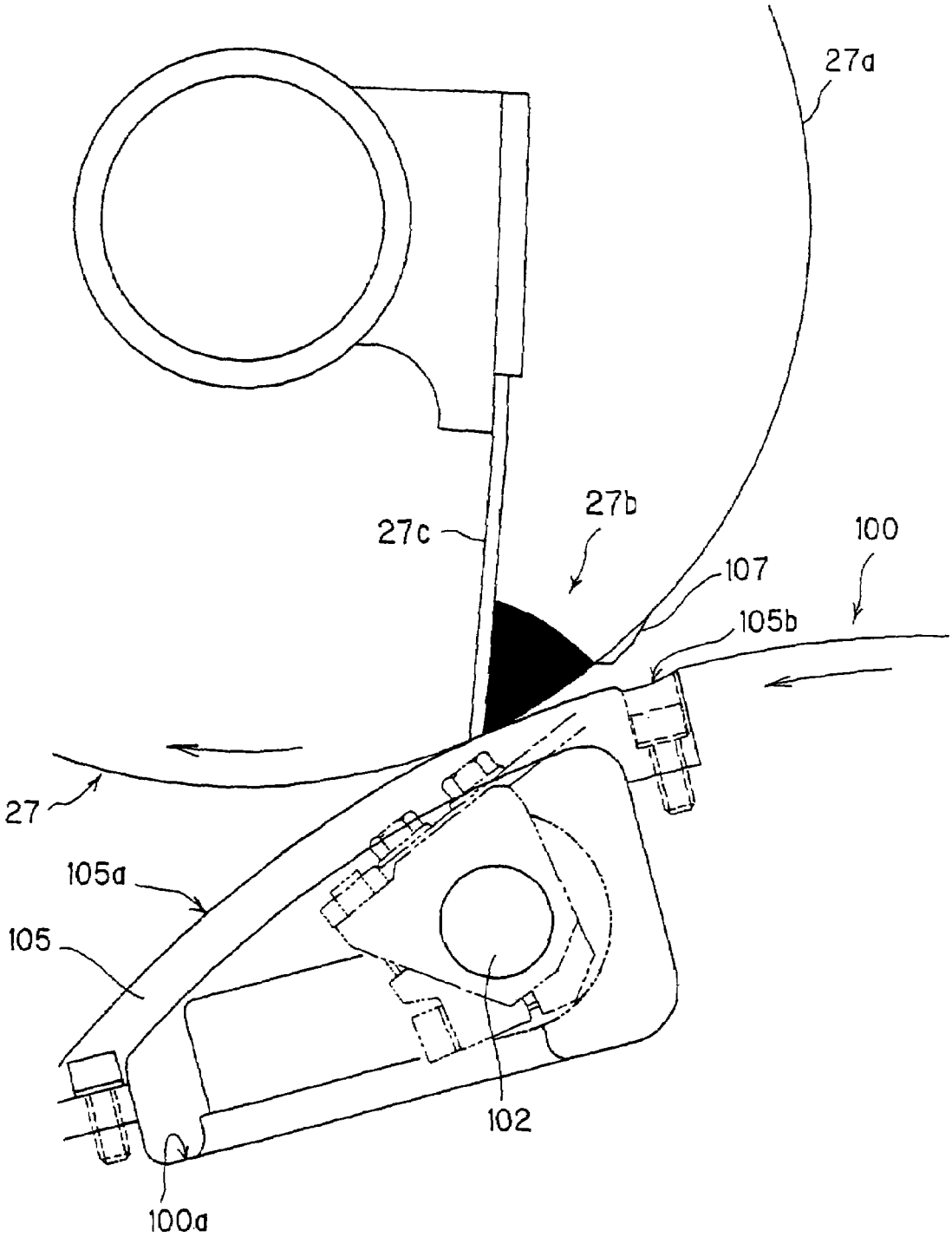
FIG. 6 is a schematic, configurational view showing essential portions of an auxiliary structure for preventing protrusion of a rotary screen into a notch of an impression cylinder.

Still another embodiment of the present invention includes an auxiliary gap guard 105 provided at a position where the gripper 101 is not present in the vicinity thereof, and a contact member 107 provided on the outer circumferential surface of the rotary screen 27. As shown in FIG. 6, as viewed in the axial direction of the impression cylinder 100, the auxiliary gap guard 105 is provided in such a manner that its outer surface is flush, in a continuous manner, with the outer circumferential surface of the impression cylinder 100 at a rotationally upstream end portion of the notch 100*a* of the impression cylinder 100. The auxiliary gap guard 105 has a relief groove 105*b* having a relief surface and formed at a rotationally upstream end portion of its outer surface. The relief surface corresponds to the upper end surface of the gripper pad 101; specifically, the relief surface is descendingly inclined in the rotational direction of the impression cylinder 100. The contact member 107 is formed in such a manner as to fit into the relief groove 105*b*. Accordingly, while damage to the leading edge of the sheet 1 is prevented, protrusion of the rotary screen 27 into the notch 10*a* can be prevented by means of a simple structure.

In this case, when the contact member 107 assumes such a shape as to come into close contact with the relief surface of the relief groove 105*b* of the auxiliary gap guard 105, the auxiliary gap guard 105 and the contact member 107 can prevent deformation of the hollow cylinder 27*a* of the rotary screen 27.

Figure 7:
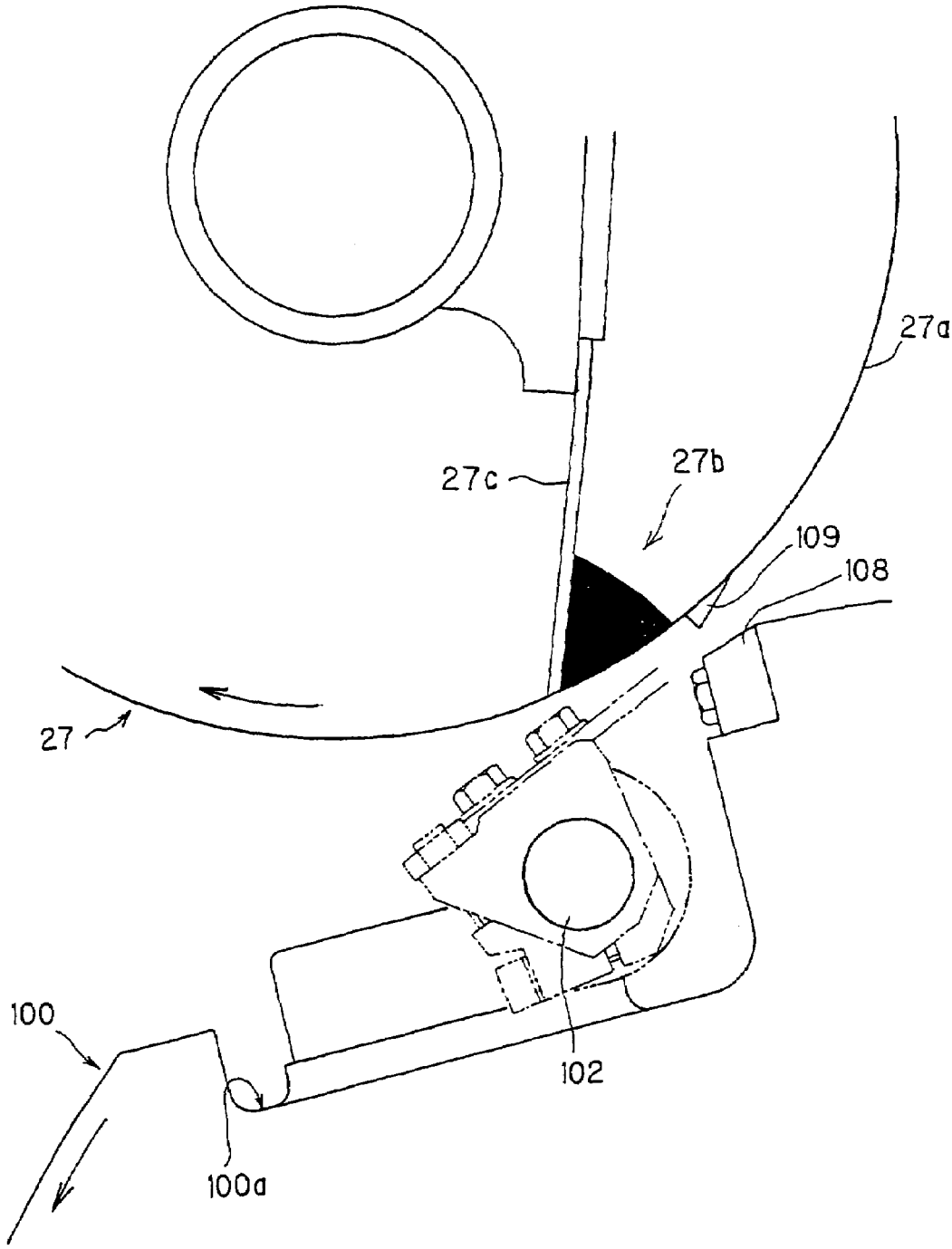
FIG. 7 is a schematic, configurational view showing essential portions of another auxiliary structure for preventing protrusion of the rotary screen into the notch of the impression cylinder.

A further embodiment of the present invention includes a relief member 108 provided in the notch 100*a* of the impression cylinder 100 at a position where the gripper pad 101 and the gap guard 105 are absent, and a contact member 109 provided on the outer circumferential surface of the rotary screen 27 and corresponding to the relief member 108. As shown in FIG. 7, the relief member 108 is located at a rotationally upstream end portion of the notch 100*a*. The relief member 108 is substantially identical in shape with the gripper pad 101 and has a relief surface. Accordingly, damage to the leading edge of the sheet 1 can be prevented more reliably.

In this case, when the contact member 109 assumes such a shape as to come into close contact with the relief surface of the relief member 108, the relief member 108 and the contact member 109 can prevent deformation of the hollow cylinder 27*a* of the rotary screen 27.

Figure 8:
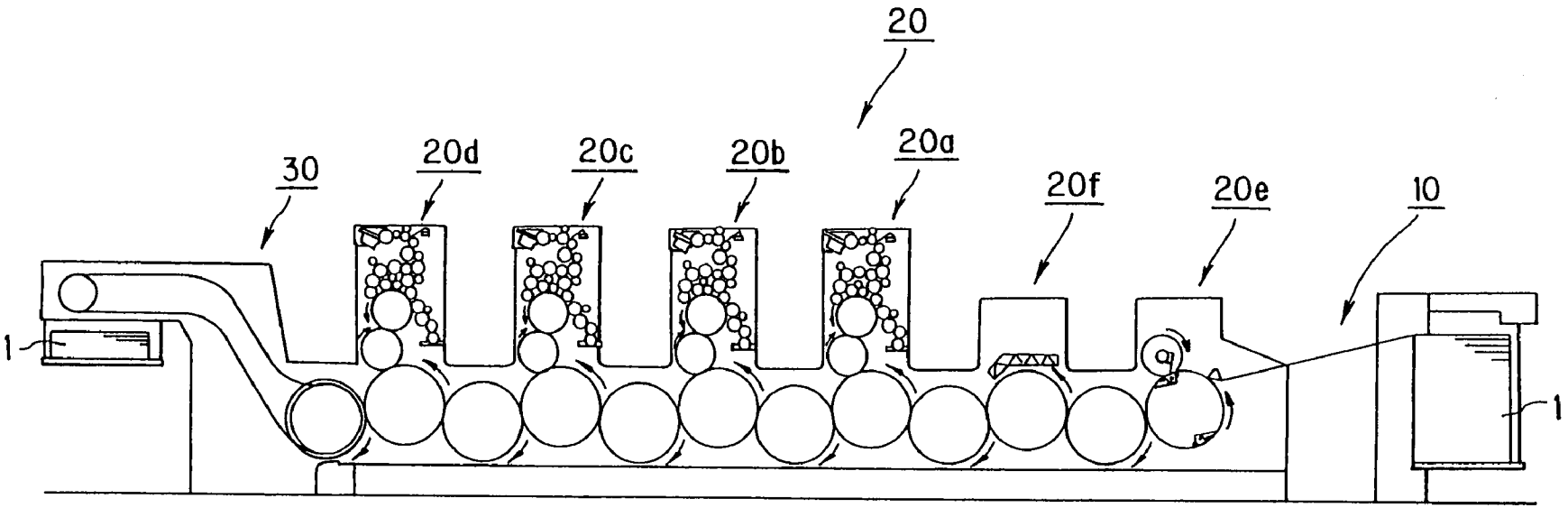
FIG. 8 is a schematic, overall, configurational view of a variant printing machine of FIG. 1.
Figure 9:
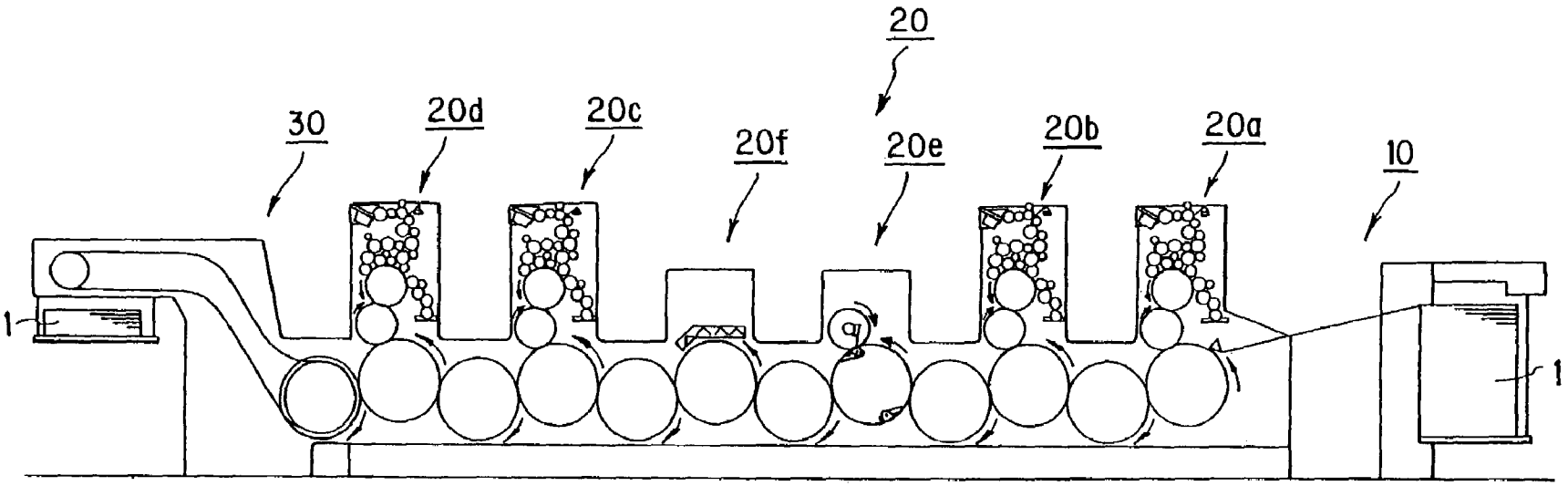
FIG. 9 is a schematic, overall, configurational view of another variant printing machine of FIG. 1.

The above embodiments are described while mentioning the screen printing unit 20*e* and the drying unit 20*f* which are disposed downstream of the first to fourth offset printing units 20*a* to 20*d*. However, the present invention is not limited thereto. For example, as shown in FIG. 8, the screen printing unit 20*e* and the drying unit 20*f* may be disposed upstream of the first to fourth offset printing units 20*a* to 20*d*. Alternatively, as shown in FIG. 9, the screen printing unit 20*e* and the drying unit 20*f* may be disposed between the first and second offset printing units 20*a* and 20*b* and the third and fourth offset printing units 20*c* and 20*d*.

Figure 10:
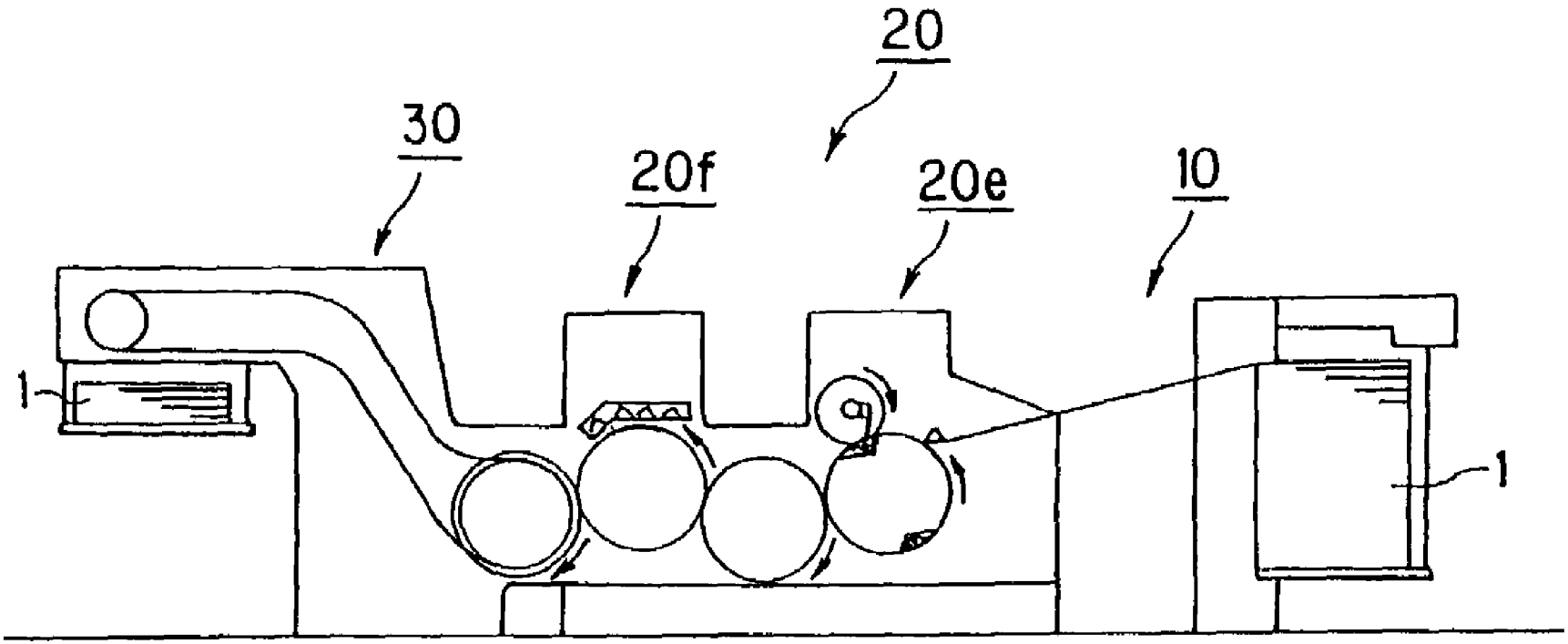
FIG. 10 is a schematic, overall, configurational view of still another variant printing machine of FIG. 1.

The above embodiments are described while mentioning application to the printing machine in which the offset printing units 20*a* to 20*d* and the screen printing unit 20*e* are combined. However, the present invention is not limited thereto. For example, as shown in FIG. 10, the liquid feeder of the present invention may be applied to a printing machine that includes the feeder 10, the screen printing unit 20*e*, the drying unit 20*f*, and the delivery unit 30 without employment of the offset printing units. Alternatively, the liquid feeder of the present invention may be used in combination with a machining unit other than a printing unit; for example, a rotary blanking unit.

The above embodiments are described while mentioning thick-application printing that is performed in such a manner that special ink or the like is contained in the ink fountain 27*b* of the rotary screen 27 of the screen printing unit 20*e*. However, the present invention is not limited thereto. For example, the liquid feeder of the present invention may be applied to any case where liquid is fed from the liquid-feeding cylinder to a sheet held on the impression cylinder, such as application to a coating apparatus for applying, to a sheet, varnish contained in the ink fountain of the rotary screen.

What is claimed is:

1. A liquid feeder, comprising:

an impression cylinder rotatably supported and having a notch formed on its outer circumferential surface;

a gripper unit disposed in the interior of the notch of the impression cylinder and including a gripper and a gripper pad for holding a sheet;

a liquid-feeding cylinder in contact with said impression cylinder and adapted to feed liquid to a sheet held by said gripper unit; and a cover member fixedly attached to said notch in such a manner as to allow said gripper of said gripper unit to project from inside said notch, said cover member having, as a part of its outer surface, a guide surface extending between a first end portion of said notch and a second end portion of said notch with respect to a circumferential direction of said impression cylinder and having a curvature substantially equal to that of said outer circumferential surface of said impression cylinder, wherein said gripper has, an outer surface and as a part of its outer surface, a guide surface having a curvature substantially equal to that of said outer circumferential surface of said impression cylinder such that, when said gripper and said gripper pad grip a said sheet therebetween, said guide surface of said gripper is flush, in a substantially continuous manner, with said outer circumferential surface of said impression cylinder at said circumferentially first end portion of said notch, said guide surface of said cover member is flush, in a continuous manner, with said outer circumferential surface of said impression cylinder at said circumferentially second end portion of said notch, and a clearance is formed between said guide surface of said cover member and said outer circumferential surface of said impression cylinder at said circumferentially first end portion of said notch, and said gripper and said cover member prevent protrusion of said liquid-feeding cylinder into said notch of said impression cylinder.

2. A liquid feeder according to claim 1, wherein said guide surface of said cover member and said guide surface of said gripper of said gripper unit overlap each other with respect to an axial direction of said impression cylinder.

3. A liquid feeder according to claim 1, wherein said guide surface of said cover member and said outer circumferential surface of said impression cylinder overlap each other with respect to an axial direction of said impression cylinder.

4. A liquid feeder according to claim 1, wherein said cover member comprises a plurality of bar-like gap guards provided at predetermined intervals along an axial direction of said impression cylinder.

5. A liquid feeder according to claim 4, wherein said gap guards and said gripper units differ in position with respect to an axial direction of said impression cylinder.

6. A liquid feeder according to claim 4, further comprising:

an auxiliary gap guard provided in such a manner that its outer surface is flush, in a continuous manner, with said outer circumferential surface of the impression cylinder at said circumferentially first end portion of said notch of said impression cylinder, with no gap being formed between said auxiliary gap guard and said outer circumferential surface of said impression cylinder, said auxiliary gap guard having a relief surface which is formed at said circumferentially first end portion and is substantially identical in shape with an upper end surface of said gripper pad of said gripper unit; and a contact member provided on an outer circumferential surface of said liquid-feeding cylinder, corresponding to and cooperating with said relief surface of said auxiliary gap guard.

7. A liquid feeder according to claim 6, wherein the shape of said contact member is set such that said contact member comes into close contact with said relief surface of said auxiliary gap guard with no gap formed therebetween.

8. A liquid feeder according to claim 7, wherein said auxiliary gap guard and said contact member prevent deformation of said liquid-feeding cylinder.

9. A liquid feeder according to claim 4, further comprising:

a relief member provided in the notch of said impression cylinder at the circumferentially first end portion of the notch, being substantially identical in shape with the gripper pad, and having a relief surface; and a contact member provided on an outer circumferential surface of the liquid-feeding cylinder, corresponding to and cooperating with said relief member.

10. A liquid feeder according to claim 9, wherein the shape of said contact member is set such that said contact member comes into close contact with said relief surface of said relief member with no gap formed therebetween.

11. A liquid feeder according to claim 10, wherein said relief member and said contact member prevent deformation of said liquid-feeding cylinder.

12. A liquid feeder according to claim 1, wherein said cover member comprises a plate-like gap guard provided in such a manner as to cover said notch of said impression cylinder, and having a guide surface in which a cutout is formed for allowing said gripper to project from inside said notch.

* * * * *